252-95 AU 166 EX
5/11/82 XR 4,329,237

United States Patent [19]
Wixon

[11] 4,329,237
[45] May 11, 1982

[54] DETERGENT SOFTENER COMPOSITIONS

[75] Inventor: Harold E. Wixon, New Brunswick, N.J.

[73] Assignee: Colgate-Palmolive Company, New York, N.Y.

[21] Appl. No.: 201,168

[22] Filed: Oct. 27, 1980

Related U.S. Application Data

[63] Continuation-in-part of Ser. No. 96,370, Nov. 21, 1979, which is a continuation-in-part of Ser. No. 968,532, Dec. 11, 1978, Pat. No. 4,230,590.

[51] Int. Cl.[3] ..... C11D 1/86; C11D 10/04; C11D 17/06; D06M 13/48

[52] U.S. Cl. ..... 252/8.75; 252/8.8; 252/92; 252/95; 252/98; 252/110; 252/117; 252/131; 252/132; 252/134; 252/135; 252/140; 252/174; 252/174.21; 252/174.25; 252/528; 252/547

[58] Field of Search ..... 252/8.75, 8.8, 92, 95, 252/98, 110, 117, 131, 132, 135, 140, 174.21, 174.25, 528, 547

[56] References Cited

U.S. PATENT DOCUMENTS

| | | | |
|---|---|---|---|
| 3,325,404 | 6/1967 | Cohen | 252/8.75 |
| 3,325,414 | 6/1967 | Inamorato | 252/110 X |
| 3,576,748 | 4/1971 | Petersson | 252/110 |
| 3,814,692 | 6/1974 | Mostow | 252/108 |
| 3,852,211 | 12/1974 | Ohren | 252/110 |
| 3,920,563 | 11/1975 | Wixon | 252/8.75 |
| 3,920,565 | 11/1975 | Morton | 252/8.75 |
| 3,954,632 | 5/1976 | Gloss | 252/8.8 |
| 4,082,682 | 4/1978 | Inamorato | 252/92 |
| 4,178,255 | 12/1979 | Stima | 252/8.8 |
| 4,183,815 | 1/1980 | Wixon et al. | 252/8.8 |

*Primary Examiner*—Dennis L. Albrecht
*Attorney, Agent, or Firm*—Kenyon and Kenyon

[57] ABSTRACT

The present invention provides heavy duty detergent compositions, particularly for imparting improved softness and detersive effects to fabrics laundered therewith, said composition including in addition to conventional builder and principally anionic surfactant components, cationic softener of the di-lower-di-higher alkyl quaternary ammonium and/or heterocyclic imide type, e.g., imidazolinium, and a mixture of fatty acid soap and nonionic organic surfactant, the weight ratio of soap to softener being about 8:1 to 1:3 preferably 5:1 to 1:2, more preferably 3:2:2:3, e.g., about unity. The soap nonionic surfactant mixture is in the form of a spaghetti, flake, or other shape and is present in the product composition as substantially homogeneously dispersed, discrete particles. A process of laundering fabrics using the above-mentioned composition is also disclosed.

33 Claims, No Drawings

DETERGENT SOFTENER COMPOSITIONS

RELATED APPLICATIONS

This application is a continuation-in-part application of U.S. Application Ser. No. 96,370, filed Nov. 21, 1979 which, in turn, is a continuation-in-part application of U.S. Application Ser. No. 968,532, filed Dec. 11, 1978, now U.S. Pat. No. 4,230,590.

FIELD OF THE INVENTION

This invention relates to detergent compositions and in particular to detergent-softener compositions capable of imparting improved softness, detersive effects, soil antiredeposition and antistatic properties to fabrics treated therewith and particularly in a machine laundering process.

BACKGROUND OF THE INVENTION

Discussion Of The Prior Art

Compositions for simultaneously achieving detergency and an appreciable level of softness in the machine laundering of fabrics, and thus suitable for use in the wash cycle, are well-known and widely available commercially. The fugitive interaction between anionic surfactant, perhaps the most commonly used of the available types of surfactants, and cationic softeners, particularly those of the di-lower-di-higher alkyl quaternary ammonium type, is likewise well recognized in the patent literature. Such interaction often results in the formation of unsightly precipitates which become entrapped within or otherwise deposit upon the fabric being washed. Discoloration or other aesthetically displeasing effects are for the most part inevitable. The net result is often a depletion in the effective amount of anionic available for useful purposes since the loss of anionic is the primary consequence.

Remedial techniques heretofore proposed to abate the aforedescribed cationic-anionic problem though divergent as to approach seem convergent as to result namely, less than satisfactory. Thus, although the most effective types of cationic quaternary ammonium softeners, as exemplified by the aforementioned di-higher alkyl type quats, such as distearyl dimethyl ammonium chloride, can function in the wash cycle in the presence of anionic, builder, etc., the quantity needed to achieve effective softening is usually coterminous with amounts promotive of undesired cationic-anionic interaction. As a general rule, at least about twice as much cationic is required for softening as for antistat.

In U.S. Pat. No. 3,325,414, dealing primarily with detergents of controlled foam or sudsing capability, the cationic-anionic problem and attendant detrimental effects are discussed in detail. The patent additionally points out that certain quaternary ammonium compounds, among the class of cationic agents, are generally unstable when heated and when in contact with alkaline builders, the instability being manufactured by the development of strong amine odors and undesirable color. The compositions of the patent are limited to the use of quaternary ammonium halides having but one higher alkyl group, the given structural formula for the cationic being correspondingly limited. Cationics of this type are markedly inferior to the di-higher alkyl types at least insofar as fabric softening activity is concerned.

Other prior art teachings at least tactically avoid the use of cationic softeners altogether proposing the use of, for example, anionic materials as softening agents. U.S. Pat. No. 3,676,338 is representative, this patent teaching the use of anionic softener referred to as "branched-chain carboxylic acids," as fabric softener. Presumably, anionic detergent would be stable in the presence of the anionic softener.

As the foregoing demonstrates, the remedies proposed necessitate the discarding of softeners and principally those of the di-higher-di-lower alkyl quaternary ammonium salt and cyclic imide types, these having been determined by experience to be among the most effective softeners thus far developed in the art.

In the above mentioned U.S. Pat. No. 4,230,590, heavy duty detergents comprising conventional builder, principally anionic surfactant components, cationic softener and a mixture of fatty acid soap and cellulose ether are disclosed. The soap-cellulose ether mixture is in the form of a spaghetti, flake or other shape and is present in the composition as substantially homogeneously dispersed, discrete particles.

In U.S. Application Ser. No. 96,370, filed Nov. 21, 1979, heavy duty detergents having compositions similar to that described in the preceeding paragraph with the exception that cellulose ether is excluded therefrom are disclosed.

Although the above mentioned soap and cationic softener containing detergent compositions possess desirable softening and detersive properties, it has been found that the solubility of such compositions is low, particularly in cold laundering temperatures. As a result, the compositions cannot be effectively used in cold water.

SUMMARY OF THE INVENTION

The present invention provides stable detergent softener compositions capable of providing improved softness, detergency, antistatic and soil antiredeposition properties to fabrics treated therewith in a laundering process in cold or hot water. The compositions generally comprise by weight from about 10 to 60% of water soluble, neutral to alkaline builder salt, from about 2to 20% of cationic softener selected from (a) aliphatic, di-(lower) $C_1$–$C_4$ alkyl, di-(higher) $C_{14}$–$C_{24}$ alkyl quaternary ammonium salts, (b) heterocyclic compounds, and mixtures of (a) and (b), and from about 2 to 20% of a mixture of water soluble or dispersible fatty acid soap and nonionic organic surfactant in spaghetti-like or other shaped, discrete form, the weight ratio of soap to softener being from about 2:3 to 3:2, the percent concentration of anionic surfactant being at least about $1.5\times+5$, x representing the percent concentration of softener, wherein the soap is substantially homogeneously dispersed in said composition preferably as discrete particles.

In the soap-nonionic surfactant mixture, the nonionic constitutes from about 2 to about 50%, preferably from about 5 to about 40%, more preferably from about 8 to about 30%, and most preferably from about 8 to about 20%, all percentages being by weight. The total nonionic surfactant content will vary from about 0.04% to about 10%, preferably from about 0.1% to about 8%, and more preferably from about 1.6% to about 6%, and most preferably from about 1.6 to about 4%, all percentages being by weight and based on the weight of the detergent composition.

In certain other aspects, the invention includes both the processes of formulating and using the aforedescribed compositions.

DETAILED DESCRIPTION OF THE INVENTION

According to the present invention, by adding a minor amount of nonionic organic surfactant to the soap spaghetti, flakes, granules and the like, the cold water solubility of the composition is improved. In addition, the softness in the fabrics laundered is unexpectedly enhanced, both in cold and hot water. The nonionic surfactant also contributes to soil antiredeposition, especially in non-phosphate formulas.

The inclusion of the nonionic organic surfactant in the present detergent softener composition has the following additonal advantages. Typically, nonionic surfactants are post-added to spray-dried detergent compositions. As a result, the post-added nonionic surfactant increases the tackiness of the detergent product. In the present invention, the nonionic surfactant is included in the soap spaghetti which leads to a significant improvement in the flowability of the composition. Furthermore, the nonionic surfactant-soap spaghetti is also beneficial to softener additives for the wash cycle as the spaghetti improves the softness of the washed fabric.

Of primary importance in the present invention is the conjoint use of the fatty acid component and the quaternary softener within the parameters given. As previously mentioned, the obtention of truly effective fabric softening with cationic softener, anionic detergent-based compositions required high concentration levels of softener, this being to the detriment of detergency, i.e., cleaning or whitening. Thus, increased cationic concentration though providing some improvement in softness, nevertheless leads to a visually discernible loss in fabric whitening due to cationic-anionic interaction, the latter being particularly acute with high softening cationic of di-higher-di-lower alkyl quaternary ammonium salt and/or heterocyclic imide types.

Surprisingly, it is found in the present invention that the use of approximately equal quantities of cationic and soap or within a 2:3 to 3:2 mutual weight ratio thereof, leads to significantly enhanced improvement in fabric softening despite the use of relatively low softener concentrations. Moreover, increase of the softener concentration well beyond the limits previously imposed due to cationic-anionic interaction has no adverse effect on cleaning and whitening and produces yet greater softening effects. Without intending to be bound by theory, it appears that the soap significantly enhances the softness of low cationic concentrations, which are at least adequate for antistat, without adversely affecting cleaning and whitening.

As will be understood, the softening capabilities of individual components are not additive when combined and in fact the cumulative effect may well be a net softness value less than that assigned for the most effective softening agent present in the combination. Thus, a plurality of poor softeners will most likely provide an equally poor net softening result. Softness is usually measured on a scale of 1 to 10 the higher values connoting increased softness.

If one were to combine equally a softener having a scale softness rating of 8, corresponding to moderate or effective softening, with a softener having a rating of 2, indicative of inferior softening, the net combined softening effect would not be additive to give a scale rating of 10, indicative of excellent softness. More than likely, the resultant softening rating would lie somewhere between the aforementioned 8 and 2 ratings indicating their respective softening effects to be mutually subtractive rather than additive. In this context, it is indeed surprising to find that the soap component herein, a material not having significant softening capabilities, actually improves, substantially, the softening effects of high softening cationics to the extent that cationic softener concentration normally considered to be effective for antistat purposes only, are likewise effective for producing excellent softening. In addition, the absence of any deleterious effects upon the detersive function of the anionic component with increased concentration of cationic enables the attainment of even greater softening effects, most notable here being the quality of fluffiness. This in turn correspondingly maximizes the antistat function of the cationic softener and particularly as regards di-higher-di-lower alky quaternary ammonium salts.

Fatty acid soaps useful herein include generally those derived from natural or synthetic fatty acids having from 10 to 30 carbons in the alkyl chain. Preferred are the alkali metals, e.g., sodium and/or potassium soaps of $C_{10}$–$C_{24}$ saturated fatty acids, a particularly preferred class being the sodium and/or potassium salts of fatty acid mixtures derived from coconut oil and tallow, e.g., the combination of sodium coconut soap and potassium tallow soap in the mutual proportions respectively of 15/85. As is known as the molecular weight of the fatty acid is increased, the more pronounced becomes its foam inhibiting capacity. Thus, fatty acid selection herein can be made having reference to the foam level desired with the product composition. In general, effective results obtain wherein at least about 50% of the fatty acid soap is of the $C_{10}$–$C_{18}$ variety. Other fatty acid soaps useful herein include those derived from oils of palm groundnut, hardened fish, e.g., cod liver and shark, seal, perilla, linseed, candlenut, hempseed, walnut, poppyseed, sunflower, maize, rapeseed, mustardseed, apricot kernel almond, castor and olive, etc. Other fatty acid soaps include those derived from the following acids: oleic, linoleic, palmitoleic palmitic linoleic, ricinoleic, capric myristic and the like, other useful combinations thereof including, without necessary limitation, 80/20 capric-lauric, 80/20 capric-myristic, 50/50 oleic-capric, 90/10 capric-palmitic and the like.

Nonionic organic surfactants useful in the present invention are known materials. Such nonionic surfactants may be broadly defined as compounds produced by the condensation of alkylene oxide groups (hydrophilic in nature) with an organic hydrophobic compound, which may be aliphatic or alkyl aromatic in nature. The length of the hydrophilic or polyoxyalkylene radical which is condensed with any particular hydrophobic group can be readily adjusted to yield a water-soluble compound having the desired degree of balance between hydrophilic and hydrophobic elements.

For example, a well known class of nonionic organic surfactants is made available on the market under the trade name of "Pluronic". These compounds are formed by condensing ethylene oxide with a hydrophobic base formed by the condensation of propylene oxide with propylene glycol. The hydrophobic portion of the molecule which, of course, exhibits water insolubility, has a molecular weight of from about 1,500 to 1,800. The addition of polyoxyethylene radicals to this hydrophobic portion tends to increase the water solubility of the molecule as a whole and the liquid character of the product is retained up to the point where polyoxyethylene content is about 50 percent of the total weight of the condensation product.

Other suitable nonionic synthetic surfactants include:

1. The polyethylene oxide condensates of alkyl phenols, e.g., the condensation products of alkyl phenols having an alkyl group containing from about six to 12 carbon atoms in either a straight chain or branched chain configuration, with ethylene oxide, the said ethylene oxide being present in amounts equal to 5 to 25 moles of ethylene oxide per mole of alkyl phenol. The alkyl substituent in such compounds may be derived from polymerized propylene, diisobutylene, octene, or nonene, for example.
2. Those derived from the condensation of ethylene oxide with the product resulting from the reaction of propylene oxide and ethylene diamine. For example, compounds containing from about 40 percent to about 80 percent polyoxyethylene by weight and having a molecular weight of from about 5,000 to about 11,000 resulting from the reaction of ethylene oxide groups with a hydrophobic base constituted of the reaction product of ethylene diamine an excess propylene oxide, said base having a molecular weight of the order of 2,500 to 3,000, are satisfactory.
3. The condensation product of aliphatic alcohols having from eight to 22 carbon atoms, in either straight chain or branched chain configuration, with ethylene oxide, e.g., a coconut alcohol-ethylene oxide condensate having from 5 to 30 moles of ethylene oxide per mole of coconut alcohol, the coconut alcohol fraction having from 10 to 14 carbon atoms.
4. Nonionic surfactants include nonyl phenol condensed with either about 10 or about 30 moles of ethylene oxide per mole of phenol and the condensation products of coconut alcohol with an average of either about 5.5 or about 15 moles of ethylene oxide per mole of alcohol and the condensation product of about 15 moles of ethylene oxide with one mole of tridecanol.

Other examples include dodecylphenol condensed with 12 moles of ethylene oxide per mole of phenol; dinonylphenol condensed with 15 moles of ethylene oxide per mole of phenol; dodecyl mercaptan condensed with 10 moles of ethylene oxide per mole of mercaptan; bis-(N-2-hydroxyethyl) lauramide; nonyl phenol condensed with 20 moles of ethylene oxide per mole of nonyl phenol; myristyl alcohol condensed with 10 moles of ethylene oxide per mole of myristyl alcohol; lauramide condensed with 15 moles of ethylene oxide per mole of aluramide; and di-iso-octylphenol condensed with 15 moles of ethylene oxide.

5. A surfactant having a formula $R^1R^2R^3N\rightarrow O$ (amine oxide detergent) wherein $R^1$ is an alkyl group containing from about 10 to about 28 carbon atoms, from zero to about two hydroxy groups and from zero to about five ether linkages, there being at least one moiety of $R^1$ which is an alkyl group containing from about 10 to about 18 carbon atoms and zero ether linkages, and each $R^2$ and $R^3$ are selected from the group consisting of alkyl radicals and hydroxyalkyl radicals containing from one to about three carbon atoms;

Specific examples of amine oxide surfactants include:
dimethyldodecylamine oxide
dimethyltetradecylamine oxide
ethylmethyltetradecylamiine oxide
cetyldimethylamine oxide
dimethylstearylamine oxide
cetylethylpropylamine oxide
diethyldodecylamine oxide
diethyltetradecylamine oxide
dipropyldodecylamine oxide
bis-(2-hydroxyethyl) dodecylamine oxide
bis-(2-hydroxyethyl)-3-dodecoxy-1-hydroxypropyl amine oxide
(2-hydroxypropyl)methyltetradecylamine oxide
dimethyloleyamine oxide
dimethyl-(2-hydroxydodecyl)amine oxide
and the corresponding decyl, hexadecyl and octadecyl homologs of the above compounds.

6. A surfactant having the formula $R^1R^2R^3P\rightarrow O$ (phosphine oxide surfactant) wherein $R^1$ is an alkyl group containing from about 10 to about 28 carbon atoms, from zero to about two hydroxy groups and from zero to about five ether linkages, there being at least one moiety of $R^1$ which is an alkyl group containing from about 10 to about 18 carbon atoms and zero ether linkages, and each of $R^2$ and $R^3$ are selected from the group consisting of alkyl radicals and hydroxyalkyl radicals containing from one to about three carbon atoms.

Specific examples of the phosphine oxide surfactants include:
dimethyldodecylphosphine oxide
dimethyltetradecylphosphine oxide
ethylmethyltetradecylphosphine oxide
cetyldimethylphosphine oxide
dimethylstearylphosphine oxide
cetylethylpropylphosphine oxide
diethyldodecylphosphine oxide
diethyltetradecylphosphine oxide
dipropyldodecylphosphine oxide
bis-(hydroxymethyl)dodecylphosphine oxide
bis-(2-hydroxyethyl)dodecylphosphine oxide
(2-hydroxypropyl)methyltetradecylphosphine oxide
dimethyloleylphosphine oxide, and
dimethyl(2-hydroxydodecyl)phosphine oxide
and the corresponding decyl, hexadecyl, and octadecyl homologs of the above compounds.

7. A surfactant having the formula

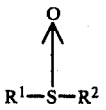

(sulfoxide detergent) where $R^1$ is an alkyl radical containing from about 10 to about 28 carbon atoms, from zero to about five ether linkages and from zero to about two hydroxyl substituents at least one moiety of $R^1$ being an alkyl radical containing zero ether linkages and containing from about 10 to about 18 carbon atoms, and wherein $R^2$ is an alkyl radical containing from one to three carbon atoms and from one to two hydroxyl groups.

octadecylmethyl sulfoxide
dodecylmethyl sulfoxide
tetradecylmethyl sulfoxide
3-hydroxytridecyl methyl sulfoxide
3-methoxytridecyl methyl sulfoxide
3-hydroxy-4-dodecoxybutyl methyl sulfoxide
octadecyl 2-hydroxyethyl sulfoxide
dodecylethyl sulfoxide Among the above-listed nonionic surfactants, the condensation product of aliphatic alcohols having from 8 to 22 carbon atoms with ethylene oxide is preferred. A typical example of such nonionic surfactant is Neodol 25-7, a product of Shell Chemical Co., which comprises the condensation product of $C_{12-15}$ alcohol with 7 moles of ethylene oxide.

Cationic softeners useful herein are known materials and are of the high-softening type. Included are the $N_1N$-di-(higher) $C_{14}$–$C_{24}$, $N_1N$-di(lower) $C_1$–$C_4$ alkyl quaternary ammonium salts with water solubilizing anions such as halide, e.g., chloride, bromide and iodide; sulfate, methosulfate and the like and the heterocyclic imides such as the imidazolinium.

For convenience, the aliphatic quaternary ammonium salts may be structurally defined as follows:

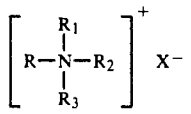

wherein R and $R_1$ represent alkyl of 14 to 24 and preferably 14 to 22 carbon atoms; $R_2$ and $R_3$ represent lower alkyl of 1 to 4 and preferably 1 to 3 carbon atoms, X represents an anion capable of imparting water solubility or dispersibility including the aforementioned chloride, bromide, iodide, sulfate and methosulfate. Particularly preferred species of aliphatic quats include:

distearyl dimethylammonium chloride
di-hydrogenated tallow dimethyl ammonium chloride
di tallow dimethyl ammonium chloride
distearyl dimethyl ammonium methyl sulfate
di-hydrogenated tallow dimethyl ammonium methyl sulfate.

Heterocyclic imide softeners of the imidazolinium type may also, for convenience, be structurally defined as follows:

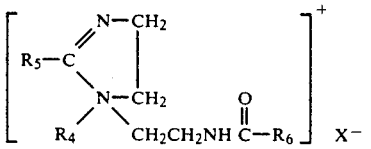

wherein $R_4$ is lower alkyl of 1 to 4 and preferably 1 to 3 carbons; $R_5$ and $R_6$ are each substantially linear higher alkyl groups of about 13 to 23 and preferably 13 to 19 carbons and X has the aforedefined significance. Particularly preferred species of imidazoliniums include:

methyl-1-tallow amido ethyl-2-tallow imidazolinium methyl sulfate; available commercially from Sherex Chemical Co. under the tradename Varisoft® 475 as a liquid, 75% active ingredient in isopropanol solvent methyl-1-oleyl amido ethyl-2-oleyl imidazolinium methyl sulfate; available commercially from Sherex Chemical Co. under the tradename Varisoft® 3690, 75% active ingredient in isopropanol solvent.

The concentration of soap and softener is from about 2 to 20% each based on the product detergent composition. For best results, the weight ratio of soap-softener is from about 2:3 to 3:2 with values approximating unity being particularly preferred. Departures from the aforestated range are not recommended since loss of softener and/or detersive effects may be severe.

It is important in one aspect of the present invention where the soap and nonionic surfactant are combined that the soap be used with at most equal and preferably minor quantity of nonionic surfactant, i.e., from about 2% to about 50% of the mixture, preferably from about 5% to about 40%, more preferably from about 8 to about 30%, and most preferably from about 8 to about 20%, based on the total soap-nonionic surfactant admixture for incorporation into the final detergent composition, usually by post blending of both soap and cationic with dried detergent. The soap and nonionic surfactant when combined may be first mixed in the desired amounts to form a substantially homogeneous mass which can be worked, according to well known technique, until it is sufficiently "doughy" or plastic to be in suitable form for, preferably, extrusion or other process, e.g., pelleting, granulation, stamping and pressing. Working may be effected, for example, by roll milling, although this is not essential, followed by extrusion in a conventional soap plodder with the desired type of extrusion head. The latter is selected in accordance with the shape, i.e., geometric form, desired in the extrudate. In the present invention, extrusion in the form of spaghetti or noodles is particularly preferred. Other shaped forms such as flakes, tablets, pellets, ribbons, threads and the like are suitable alternatives. Special extruders for the foregoing purposes are well known in the art and include for example Elanco models EXD-60; EXDC-100; EX-130 and EXD-180, a Buhler extruder and the like. Generally, the spaghetti extrudate is a form-retaining mass, i.e., semi-solid and essentially nontacky at room temperature requiring in most cases no further treatment such as water removal. If necessary, the latter can be effected by simple drying techniques. The spaghetti should have an average length of from about 2 to 20 mm. with about 95% thereof within a tolerance of 0.5 to 20 mm. and an average diameter or width of from about 0.2 to 2.0 mm. with a range of 0.4 to 0.8 mm. being preferred. The bulk density of the spaghetti will usually, having reference to the type of fatty acid soap and nonionic surfactant used, be from about 0.9 to 1.3 g/cm$^3$. Flakes will measure about 4 mm. in length and breadth and 0.2 mm. in thickness, pellets have a cross section of about 2.5 mm. while tablets have a cross section of 2.5 mm. and a thickness of 2.5 mm.

Water dispersibility of the shaped extrudate at cold or hot laundering temperatures is excellent; where the fatty acid soap nonionic surfactant combination is used, the combination possesses enhanced dispersibility and/or solubility in a fabric washing medium containing the ultimate product composition with concomitant enhancement of antiredeposition effects. Nonionic surfactants, as is known, are commonly used as soil antiredeposition agents; in the present invention, their performance as such is optimized. Nonionic surfactants which are typically post-added to the spray-dried detergent compositions increase the tackiness of the compositions, as is well known. By including the nonionic surfactant in the soap spaghetti, the flowability of the detergent composition is improved significantly. Extrusion methods particularly relevant to the foregoing are described, for example, in U.S. Pat. No. 3,824,189 and British Pat. No. 1,204,123; also relevant in this regard is U.S. Pat. No. 3,726,813.

In accordance with preferred embodiments, the soap spaghetti with combined nonionic surfactant as well as cationic softener are dry blended, by post addition, with dried detergent in particulate form such as granules, beads, and the like, the detergent having been prepared as is customary in the art, e.g., spray drying a crutcher mix of surfactant, builder filler, and other conventional ingredients. However, it is within the scope of the invention to add part or all of the soap-spaghetti to the crutcher mix since this procedure likewise results in the desired dispersion of the soap spaghetti as discrete particles.

In any event, it is advisable to maintain physical separation of the soap and cationic softener and thus inclusion of the softener in the soap spaghetti should be avoided. The aforedescribed post-blending expedient usually insures against any appreciable, inadvertent contacting of soap and softener since these are added as separate components to the detergent in dry form. Though the soap spaghetti can be added to the crutcher, cationic softener nevertheless is post-added as explained. Although surfactants of conventional type can be used herein, it is preferred that at least about 90% and preferably at least about 95% of the total surfactant or detergent be of the anionic type, these materials being particularly beneficial in heavy duty detergent for fabric washing. Anionics for use herein generally include the water soluble salts of organic reaction products having in their molecular structure an anionic solubilizing group such as $SO_4H$, $SO_3H$, COOH and $PO_4H$ and an alkyl or alkyl group having about 8 to 22 carbons in the alkyl group or moiety. Suitable detergents are anionic detergent salts having alkyl substituents of 8 to 22 carbon atoms such as: water soluble sulfated and sulfonated anionic alkali metal and alkaline earth metal detergent salts containing a hydrophobic higher alkyl moiety, such as salts of higher alkyl mono-or polynuclear aryl sulfonates having from about 8 to 18 carbon atoms in the alkyl group which may have a straight preferred or branched chain structure, preferred species including, without necessary limitation: sodium linear tridecylbenzene sulfonate, sodium linear dodecyl benzene sulfonate, sodium linear decyl benzene sulfonate, lithium or potassium pentapropylene benzene sulfonate; alkali metal salts of sulfated condensation products of ethylene oxide, e.g., containing 3 to 20 and preferably 3 to 10 moles of ethylene oxide, with aliphatic alcohols containing 8 to 18 carbon atoms or with alkyl phenols having alkyl groups containing 6 to 18 carbon atoms, e.g., sodium nonyl phenol pentaethoxamer sulfate and sodium lauryl alcohol triethoxamer sulfate; alkali metal salts of saturated alcohols containing from about 8 to 18 carbon atoms, e.g., sodium lauryl sulfate and sodium stearyl sulfate; alkali metal salts of higher fatty acid esters of low molecular weight alkylol sulfonic acid, e.g., fatty acid esters of the sodium salt of isethionic acid; fatty ethanolamide sulfates; fatty acid amides of amino alkyl sulfonic acids, e.g., lauric acid amine of taurine; alkali metal salts of hydroxy alkane sulfonic acids having 8 to 18 carbon atoms in the alkyl group, e.g., hexadecyl, alphahydroxy sodium sulfonate. The anionic or mixture thereof is used in the form of their alkali or alkaline earth metal salts. The anionic is preferably of the non-soap type, it being preferred that the soap component be utilized as taught herein. However, minor amounts of soap, e.g., up to about 35% and preferably 20% based on total anionic can be separately added, for example, to the crutcher mix. The concentration of non-soap anionic should be selected so as to provide an excess with respect to cationic-softener according to the empirical relationship $$\% \text{ concentration} \geqq 1.5x + 5$$

wherein x is the percent concentration of cationic softener. This assures the minimum excess of anionic necessary for optimum overall detergency, softening, etc. performance in the product composition.

Minor amounts of other types of detergents can be included along with the anionic, their sum in any case not exceeding about 10% and preferably about 2–5% of total detergent, i.e., such other detergent plus non-soap anionic. Useful here are the nonionic surface active agents which contain an organic hydrophobic group and a hydrophilic group which is a reaction product of a solubilizing group such as carboxylate, hydroxyl, amido or amino with ethylene oxide or with the polyhydration product thereof, polyethylene glycol. Included are the condensation products of $C_8$ to $C_{30}$ fatty alcohols such as tridecyl alcohol with 3 to 100 moles ethylene oxide; $C_{16}$ to $C_{18}$ alcohol with 11 to 50 moles ethylene oxide; ethylene oxide adducts with monoesters of polyhydric, e.g., hexahydric alcohol; condensation products of polypropylene glycol with 3 to 100 moles ethylene oxide; the condensation products of alkyl ($C_6$ to $C_{20}$ straight or branched chain) phenols with 3 to 100 moles ethylene oxide and the like.

Suitable amphoteric detergents generally include those containing both an anionic group and a cationic group and a hydrophobic organic group which is preferably a higher aliphatic radical of 10 to 20 carbon atoms; examples include the N-long chain alkyl aminocarboxylic acids and the N-long chain alkyl iminodicarboxylic acids such as described in U.S. Pat. No. 3,824,189.

The compositions herein preferably include water soluble alkaline to neutral builder salt in amounts of from about 10 to 60% by weight of total composition. Useful herein are the organic and inorganic builders including the alkali metal and alkaline earth metal phosphates, particularly the condensed phosphates such as the pyrophosphates or tripolyphosphates, silicates, borates, carbonates, bicarbonates and the and the like. Species thereof include sodium tripolyphosphate, trisodium phosphate, tetrasodium pyrophosphate, sodium acid pyrophosphate, sodium monobasic phosphate, sodium dibasic phosphate, sodium hexametaphosphate; alkali metal silicates such as sodium metasilicate, sodium silicates: $Na_2O/SiO_2$ of 1.6:1 to 3.2:1, sodium carbonate, sodium sulfate, borax (sodium tetraborate) ethylene diamine tetraacetic acid tetrasodium salt, trisodium nitrilotriacetate and the like and mixtures of the foregoing. Builder salt may be selected so as to provide either phosphate-containing or phosphate-free detergents. As to the latter embodiments, sodium carbonate is particularly effective. Another material found to provide good detergency effects is metakaolin which is generally produced by heating kaolinite lattice to drive off water producing a material which is substantially amorphous by x-ray examination but which retains some of the structural order of the kaolinite. Discussions of kaolin and metakaolin are found in U.S. Pat. No. 4,075,280 columns 3 and 4 and Grimshaw, "The Chemistry of Physics of Clays and Allied Ceramic Materials," (4th ed., Wiley-Interscience), pages 723–727. Metakaolin is also the subject of U.S. Patent applications Ser. Nos. 905,622 and 905,718, the relevant disclosures of which are herein incorporated by reference. The metakaolin also appears to have softening utility. As to the latter, the most effective metakaolins appear to be those which behave best in the reaction with sodium hydroxide to form zeolite 4A as described in U.S. Pat. No. 3,114,603 which refers to such materials as "reactive kaolin." As explained in the referenced sources, metakaolin is an aluminosilicate. The metakaolin and/or a zeolite is included in about the same amounts as the builder salt, and preferably supplemental thereto, e.g., zeolitesilicate in a ratio of 6:1. A particularly useful form of the metakaolin is that available commercially as Satintone No. 2.

Preferred optional ingredients useful herein include perfume such as Genie perfume; optical brighteners and bluing agents which may be dyes or pigments, suitable materials in this regard including stilbene and Tinopal 5BM brighteners and particularly in combination and Direct Brilliant Sky Blue 6B, Solophenyl Violet 4BL, Cibacete, Brilliant Blue RBL and Cibacete Violet B, Polar Brilliant Blue RAW and Calcocid Blue 2G bluing agents. The brightener may be included in amounts ranging up to about 1% of the total composition while bluing agents may range up to about 0.1% preferably up to about 0.01% of total composition. Bluing agent, e.g., Polar Brilliant Blue may be included in the soap spaghetti. In either case, the amount need only be minimal to be effective.

Other ingredients of optimal significance include bleaching agents which may be of the oxygen or chlorine liberating type; oxygen bleaches include sodium and potassium perborate, potassium monopersulfate and the like, while chlorine bleaches are typified by sodium hypochlorite, potassium dichloroisocyanurate, trichloroisocyanuric acid and the like. The latter chlorine-liberating bleaches are representative of the broad class of water soluble, organic, dry solid bleaches known as the N-chloro imides including their alkali metal salts. These cyclic imides have from about 4 to 6 member in the ring and are described in detail in U.S. Pat. No. 3,325,414. Each of the oxygen and chlorine type bleaches discussed above are fully compatible with the compositions herein and have good stability in the presence of the anionic and cationic components. They are generally used in proportions ranging from about 0.1 to 25% by weight of total solids or from about 0.05% to about 20% based on total detergent composition.

Yet additional optional ingredients include water soluble and/or dispersible hydrophobic colloidal cellulosic soil suspending agent. Methyl cellulose, e.g., Methocel® is particularly effective. Polyvinyl alcohol is likewise effective and especially in the washing of cotton and synthetic fibers such as nylon, dacron and resin treated cotton. The additional soil suspending agent may be included in amounts up to about 2% based on total solids and up to about 4% based on total detergent composition. However, it must be emphasized that the nonionic organic surfactant component of the soap spaghetti supplies at least a major part of the anti-redeposition or soil suspending function, its effectiveness in this regard being significantly augmented by the soap material as previously explained.

Fillers may also be included in addition to the aforementioned ingredients, such as sodium sulfate, sodium chloride and the like. The amount will range up to about 40% of total composition.

The detergent composition is prepared by conventional processing such as spray drying a crutcher mix of surfactant, builder, filler etc. with volatile ingredients such as perfume or ingredients otherwise adversely affected by the spray drying process such as peroxygen bleach, e.g., sodium perborate. Ingredients of this type are preferably post blended. As previously mentioned, the soap spaghetti and cationic amine softener are simply dry blended with the dried detergent in particulate form by simple mechanical mixing which is more than adequate to achieve a homogeneous product. As previously explained, part or all of the soap spaghetti may alternatively be added to the aqueous crutcher mixture. A typical procedure would be as follows: Water is added to a crutcher followed in order by anionic, sodium silicate, optional ingredients where used such as Satintone #2 and filler such as sodium sulfate and builder salt. The crutcher mixture is heated to about 140° F. before addition of builder, e.g., sodium tripolyphosphate and the solids content of the crutched mixture before spray drying is about 55–65%. Spray drying may be carried out in a conventional manner by pumping the hot mixture from the crutcher to a spray tower where the mixture passes through a spray nozzle into a hot evaporative atmosphere. Bleach and other materials remaining to be added are incorporated into the cooled, dried detergent mass by any suitable means such as simple mechanical mixing.

In use, sufficient of the detergent composition is added to the wash cycle to provide a concentration of cationic softener in the wash medium of about 1.5 to 8.0 g/3500 g laundry with a range of 1.8 to 6.0 g being preferred. Washing temperature may range from about 70° to the boil (i.e., about 212° F.). In this connection, it is understood that by "cold" wash is meant a washing temperature of up to 70° F., "warm" is from above 70° F. to below 120° F., preferably 90° F., and "hot" is from 120° F. to boiling.

Certain types of aliphatic quaternary ammonium compounds though relatively ineffective as regards softening are nevertheless quite effective as antistats in the compositions herein and particularly since they are physically compatible with anionic surfactant in liquid environments. In general, such materials encompass the ethoxylated and/or propoxylated quaternary ammonium compounds of the following formula:

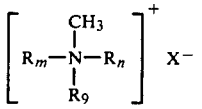

wherein $R_m$ and $R_n$ represent ethoxy or propoxy, m and n are integers of from 1 to 50 and may be the same or different and $R_9$ represents alkyl of 14 to 24 carbon. Compounds of this type include (a) methylbis (2-hydroxy-ethyl) coco ammonium chloride a liquid 75% active ingredient in isopropanol/water solvent and available commercially as Ethoquad® c/12, Armak and Variquat® 638, Sherex Chemical Co.; (b) Ethoquad c/25—same as in (a) but having 15 moles of ethylene oxide (each of $R_m$ and $R_n$) and available as 95% active ingredient; (c) methylbis (2-hydroxy-ethyl) octadecyl ammonium chloride, a liquid, 75% active ingredient in isopropanol/water solvent available commercially as Ethoquad 18/12, Armak and (d) same as (c) but having 15 moles of ethylene oxide (each of $R_m$ and $R_n$), a liquid, 95% active ingredient and available commercially as Ethoquad 18/15, Armak. These materials can be used in amounts ranging up to about 10% by weight of the total composition.

The following examples are given for purposes of illustration only and are not intended to limit the invention. All parts and percentages are given by weight.

EXAMPLE 1

This example illustrates the solubility of the soap/-nonionic surfactant mixture in cold, warm and hot water.

A soap/nonionic surfactant spaghetti composition comprising 80% by weight tallow/coco (85/15) soap and 20% Neodol (a product of the Shell Chemical Co. which is a $C_{12-15}$ alcohol condensed with 7 moles of ethylene oxide) is prepared. The solubility of the composition in water at different temperatures is measured and summarized in Table 1.

TABLE 1

| Wt. content of nonionic surfactant % | Temperature °F. | Minutes to dissolve (1 g/liter) |
|---|---|---|
| 0 | 70 | >15 |
| 20 | 70 | 4 |
| 20 | 90 | 2 |
| 20 | 120 | 1 |

EXAMPLES 2-6

Example 1 is repeated except that different amounts of nonionic surfactant are included in the composition. The results are summarized in Table 2.

TABLE 2

| Example No. | Wt. content of soap in composition % | Temperature °F. | Time to dissolve (1g/l liter) (minutes) |
|---|---|---|---|
| 2 | 100 | 70 | >15 |
| | 100 | 90 | 9 |
| | 100 | 120 | 1 |
| 3 | 95 | 70 | >15 |
| | 95 | 90 | 3 |
| | 95 | 120 | 1 |
| 4 | 90 | 70 | 10 |
| | 90 | 90 | 1.75 |
| | 90 | 120 | 1 |
| 5 | 85 | 70 | 8.5 |
| | 85 | 90 | 1.75 |
| | 85 | 120 | 1 |
| 6 | 80 | 70 | 6 |
| | 80 | 90 | 1.75 |
| | 80 | 120 | 1 |

EXAMPLES 7 and 8

Example 1 is repeated except that the soap used is 100% coco and different amounts of nonionic surfactants are included in the soap-nonionic surfactant composition. The results are summarized in Table 3.

TABLE 3

| Example No. | Wt. content of soap % | Temperature °F. | Time to dissolve 1g/l liter (min) |
|---|---|---|---|
| 7 | 100 | 70 | >15 |
| | 100 | 90 | 1 |
| | 100 | 120 | 1 |
| 8 | 90 | 70 | 8 |
| | 90 | 90 | 1.75 |
| | 90 | 120 | 1 |

Examples 1-8 show that increase in the content of the nonionic surfactant improves the solubility of the soap/-nonionic surfactant mixture in cold water.

EXAMPLE 9

A spray dried heavy duty detergent having the following composition is provided:

| Component | Wt. % |
|---|---|
| Linear tridecylbenzene sulfonate (LTBS) | 15 |
| Tripolyphosphate sodium (NaTPP) | 33 |
| Silicate | 7 |
| Brightener (Stilbene & Tinopal 5BM) | .48 |
| Q.S. sodium sulfate and water | 44.52 |
| | 100.00 |

To 90 g of the above composition are added:

| | Grams |
|---|---|
| Distearyl dimethyl ammonium chloride (Arosurf TA-100 Sherex Chemical Co., 93% AI powder) | 5 |
| Soap spaghetti (80% weight tallow/coco 85/15 soap; and 20% Neodol 25-7 (Shell Chemical Co.), spaghetti length = 15 mm and diameter = 0.5mm to provide a homogeneous composition by simple mechanical mixup. | 5 |

Washing tests with the foregoing composition are conducted using a General Electric washer, 17 gallons tap water at a temperature of 120° F. (approximately 100 ppm hardness), tests are conducted on a single towel. The fabric softness is evaluated on a scale of 1 (no softness) to 10 (excellent softness), whiteness (−b) readings which are taken on Gardner Color. Difference meter is used in the usual manner, about 0.5 units of b readings are visually discernible and with higher values indicating increased whiteness. The towels washed as indicated above are evaluated as to softness and whiteness.

EXAMPLE 10

Example 1 is repeated except that the soap spaghetti comprises soap and carboxymethyl cellulose. The results of Examples 9 and 10 are shown below.

| | Softness | | Whiteness (−b)* | |
|---|---|---|---|---|
| Example No. | 70° F. | 120° F. | 70° F. | 120° F. |
| 9 | 10+ | 10+ | −5.6 | −6.0 |
| 10 | 10 | 10 | −5.9 | −5.8 |

*Higher minus b values are whiter; about 0.5 b unit is visually detectable.

EXAMPLE 11

Example 9 is repeated but using a detergent composition having the following proximate analysis.

| Component | Wt. % |
|---|---|
| Linear dodceyl benzene sulfonate | 23 |
| $Na_2CO_3$ | 20 |
| Silicate | 15 |
| Borax | 3 |
| Nonionic surfactant | 1 |
| Soap | 2 |
| Carboxymethyl cellulose | 1 |

-continued

| Component | Wt. % |
|---|---|
| Brightener* | 0.48 |
| Satintone | 1 |
| $Na_2SO_4$ and water | Q.S. |

*Stilbene and Tinopal 5BM

To 90 grams of the above composition, 5 gm of Arosurf TA-100 and 5 gm of soap/nonionic surfactant spaghetti of Example 9 are added as described in Example 9. Softness and brightness measurements are taken on washed towel specimens as described in Example 9.

EXAMPLE 12

Example 11 is repeated except 5 gm of a soap/carboxymethyl cellulose spaghetti is used in place of the soap/-nonionic surfactant spaghetti.

EXAMPLE 13

Example 11 is repeated except that 4 gm of Arosurf TA-100 and 5 gm of soap/nonionic surfactant spaghetti of Example 9 are used

EXAMPLE 14

Example 11 is repeated except that 4 gm of Arosurf TA-100 and 4 g of the soap/nonionic surfactant spaghetti of Example 9 are used.

EXAMPLE 15

Example 11 is repeated except that 4 gm of Arosurf TA-100 and 4 g of the soap/carboxymethyl cellulose spaghetti of Example 9 are used.

The results of Examples 11–15 are summarized below.

| | Softness | | Whiteness (−b) | |
|---|---|---|---|---|
| Example No. | 70° F. | 120° F. | 70° F. | 120° F. |
| 11 | 10++ | 10+ | −4.3 | −5.7 |
| 12 | 10 | 10 | −5.6 | −6.3 |
| 13 | 10+ | 10 | −5.0 | −6.0 |
| 14 | 10 | 9 | −5.3 | −5.5 |
| 15 | 9 | 9 | −4.1 | −4.2 |

EXAMPLE 16

The following heavy duty detergent composition is prepared.

| Component | Wt. % |
|---|---|
| Linear alkyl benzene sulfonate | 9 |
| Alcohol ether sulfate | 8 |
| Nonionic surfactant | 2 |
| Tripolysulfate sodium | 24 |
| Zeolite | 17 |
| $Na_2SO_4$, brightener, water | Q.S. |

The washing test outlined in Example 9 is repeated at a temperature of 120° F. using 100 g of the above detergent composition.

EXAMPLE 17

Example 16 is repeated except that in addition to the detergent composition of Example 16 5 g of Arosurf TA-100, 5 g of the soap/nonionic surfactant spaghetti of Example 9 and 20 gm of a spray-dried granular additive having the following composition are used.

| Component | Wt. % |
|---|---|
| $NaHCO_3$ | 46 |
| $Na_2CO_3$ | 32 |
| Brightener | 2.5 |
| Silicate | 13.5 |
| Blue dye and moisture | 6 |
| | 100.0 |

EXAMPLE 18

Example 17 is repeated except that the soap/nonionic surfactant spaghetti is replaced by soap/carboxymethyl cellulose spaghetti.

The results of Examples 16–18 are summarized below.

| Example | Softness 120° F. | Whiteness (−b) 120° F. |
|---|---|---|
| 16 | 1 | −5.2 |
| 17 | 10 | −6.3 |
| 18 | 8 | −5.5 |

EXAMPLE 19

An unperfumed powder detergent composition having the following formulation is prepared.

| Component | Wt. % |
|---|---|
| Linear tridecylbenzene sulfonate | 14.8 |
| Tripolyphosphate sodium | 26.5 |
| Silicate | 6.9 |
| Brightener (Stilbene and Tinopal 5 BM) | 0.47 |
| Sodium carbonate | 4.9 |
| Carboxymethyl cellulose | 0.25 |
| Methocel | 0.6 |
| Sodium sulfate, moisture | Q.S. |

To 90.6 parts by weight of the above unperfumed powder detergent are added:

| | |
|---|---|
| Distearyl dimethyl ammonium chloride (Arosurf TA-100 Sherex Chemical Co., 93% AI powder) | 4.0 parts |
| Soap spaghetti (90% tallow/coco 85/15; 10% Neodol 25-7 (Shell Chemical Co.), spaghetti length = 15 mm, diameter = 0.5 mm | 4.0 parts |
| Borax Pentahydrate | 0.7 parts |
| Nonionic surfactant (Neodol 25-7) | 0.5 parts |
| Perfume | 0.2 parts |

The washing procedure set out in Example 9 is repeated using the above mixture. The results obtained are similar to those shown in Example 14.

Examples 9–19 show that by using the composition of the present invention, improved softness in the laundered fabric can be obtained even at cold laundering temperatures without decreasing the brightness thereof.

What is claimed is:

1. A detergent softener composition capable of imparting improved softness, detergency, antistatic and soil antiredeposition properties to fabrics treated therewith in the wash cycle of a laundering process comprising a particulate detergent base containing from about 5 to 40% by weight relative to the composition, of a water soluble non-soap, organic surfactant, at least about 90% thereof being of the anionic type, and from about 10 to 60% by weight relative to the composition, of water soluble, neutral to alkaline builder salt; said detergent base being (I) in admixture with discrete particles of cationic amine softener, said softener being selected from the group consisting of (a) aliphatic di-(lower) $C_1$–$C_4$ alkyl, di(higher) $C_{14}$–$C_{24}$ alkyl quaternary ammonium salts (b) heterocyclic compounds, and mixtures of (a) and (b), and (II) in admixture with discrete particles of a mixture of water soluble or dispersible fatty acid soap and nonionic organic surfactant, said nonionic constituting from about 2 to about 50% by weight of the mixture, the weight ratio of soap to softener being from about 8:1 to 1:3, the percent concentration of anionic surfactant being at least about $1.5\times+5$, wherein x represents the percent concentration of softener, said softener particles comprising from about 2 to 20% by weight of the composition and being free of the soap-nonionic mixture, said soap-nonionic mixture particles comprising from about 2 to 20% be weight of the composition and being free of the cationic softener, and said detergent base being free of cationic softener.

2. A composition according to claim 1 wherein said soap comprises an alkali metal salt $C_{10}$–$C_{30}$ fatty acid, at least about 50% thereof being $C_{10}$–$C_{18}$ fatty acid.

3. A composition according to claim 2 wherein said soap is a mixture of coconut oil and tallow fatty acid salts.

4. A composition according to claim 3 wherein said soap is an 85/15 tallow/coco mixture.

5. A composition according to claim 1 wherein said nonionic organic surfactant is selected from the group consisting of the condensation product of alkylene oxide groups with alkyl phenols and aliphatic alcohols containing from 8–22 carbon atoms, and block copolymers of ethylene oxide/propylene oxide.

6. A composition according to claim 1 wherein said softener is distearyl, dimethyl ammonium chloride.

7. A composition according to claim 1 wherein said softener is di-hydrogenated tallow dimethyl ammonium chloride.

8. A composition according to claim 1 wherein said softener is methyl-1-tallow amido ethyl-2-tallow-imidazolinium methyl sulfate.

9. A composition according to claim 1 wherein said softener is methyl-1-oleyl amido ethyl-2-oleyl imidazolinium methyl sulfate.

10. A composition according to claim 1 wherein the ratio of soap to softener is about 1:1.

11. A composition according to claim 1 wherein said builder salt is sodium tripolyphosphate.

12. A composition according to claim 10 wherein said builder salt is sodium tripolyphosphate.

13. A composition according to claim 1 wherein said anionic detergent is linear tridecylbenzene sulfonate.

14. A composition according to claim 1 wherein said anionic detergent is linear dodecyl benzene sulfonate.

15. A composition according to claim 1 containing from about 5 to 45% of metakaolin.

16. A composition according to claim 1 containing from about 5 to 45% of zeolite.

17. A composition according to claim 1 containing up to about 25% of water soluble fabric bleaching agent.

18. A composition according to claim 17 wherein said bleaching agent is alkali metal perborate.

19. A composition according to claim 1 wherein the concentration of each of the softener and soap is at least about 4%.

20. A composition according to claim 5 wherein the nonionic organic surfactant comprises the condensation product of $C_{12-15}$ alcohol with 7 moles of ethylene oxide.

21. A composition according to claim 1 wherein the concentration of nonionic in the soap/nonionic organic surfactant mixture is from about 5 to 40%, by weight.

22. A composition according to claim 21 wherein the concentration of nonionic is from about 8 to 30%, by weight.

23. A composition according to claim 22 wherein the concentration of nonionic is from about 8 to about 20%, by weight.

24. A detergent-softener composition of claim 1 comprising about;

5% distearyl dimethyl-ammonium chloride
5% soap spaghetti consisting of 80% tallow/coco, 85/15 soap and 20% $C_{12-15}$ alcohol. 7 mols ethylene oxide surfactant and
90% of the following detergent composition:
15% linear tridecylbenzene sulfonate
33% sodium tripolyphosphate
7% silicate
1% borax
0.48% brightener
Q.S. sodium sulfate and water

25. A detergent softener composition of claim 1 comprising about

5% distearyl dimethyl ammonium chloride
5% soap spaghetti consisting of 80% tallow/coco, 85/15 soap and 20% $C_{12-15}$ alcohol 0.7 mols ethylene oxide surfactant
and 90% of the following detergent composition:
23% linear dodecyl benzene sulfonate
20% sodium carbonate
15% silicate
3% borax
1% nonionic surfactant
2% fatty acid soap
1% carboxymethyl cellulose
0.48% brightener
1% metakaolin clay
Q.S. sodium sulfate and water

26. A detergent softener composition of claim 1 comprising about:

4% distearyl dimethyl ammonium chloride
5% soap spaghetti consisting of 80% tallow/coco, 85/15 soap and 20% of $C_{12-15}$ alcohol 0.7 mols ethylene oxide surfactant
and 91% of the following detergent composition
23% linear dodecylbenzene sulfonate
20% sodium carbonate
1% nonionic surfactant
3% borax
2% fatty acid soap
15% silicate
1% carboxymethyl cellulose
0.48% brightener
Q.S. sodium sulfate and water.

27. A detergent softener composition of claim 1, comprising about:

5 parts by weight of distearyl dimethyl ammonium chloride, 5 parts by weight of soap spaghetti consisting of 80% tallow/coco (85/15) soap and 20% of $C_{12-15}$ alcohol 7 mols ethylene oxide surfactant, 20 parts by weight of a spray-dried granular additive having the following composition:

| | |
|---|---|
| 46% by weight | $NaHCO_3$ |
| 32% by weight | $Na_2CO_3$ |
| 2.5% by weight | brightener |
| 13.5% by weight | silicate |
| Q.S. | blue dye and moisture, |

and 60 parts by weight particulate detergent base containing, in percent by weight:

9% linear alkyl benzene sulfonate
8% alcohol ether sulfate
2% nonionic surfactant
24% tripolyphosphate sodium
17% zeolite
Q.S. sodium sulfate, brightener, water.

28. A detergent softener composition of claim 1 comprising about

4% distearyl dimethyl ammonium chloride
4% soap spaghetti consisting of 90% tallow/coco 85/15 soap and 10% of $C_{12-15}$ alcohol 7 mols ethylene oxide surfactant.
0.7% borax
0.5% nonionic surfactant
0.2% perfume, and
90.6% of the following detergent composition:
14.8% linear tridecylbenzene sulfonate
26.5% sodium tripolyphosphate
6.9% silicate
0.47% brightener
4.9% sodium carbonate
0.25% carboxymethyl cellulose
0.6% methocel
Q.S. sodium sulfate and moisture.

29. A process for washing fabrics comprising contacting said fabrics in an aqueous medium at a temperature of from about 70° to 170° F. with sufficient of the composition of claim 1, 24, 25, 26, 27 or 28 to provide a ratio of from 1.5 to 8.0 g of softener per 3500 g of fabric.

30. A detergent softener composition, which comprises:

a dry-blended mixture of
about 2 to 20 weight percent discrete cationic softener particles,
about 2 to 20 weight percent discrete particles of a fatty acid soap and nonionic surfactant mixture,
about 5 to 40 weight percent water soluble non-soap, organic surfactant, at least about 90% thereof being of the anionic type,
from about 10 to 60 weight percent of a water soluble, neutral to alkaline builder salt;
said surfactant and said builder salt being combined together as a particulate detergent base before being mixed with the said softener and soap-nonionic particles,
said softener particles being free of the soap-nonionic mixture,
said soap-nonionic mixture particles and said detergent base being free of cationic softener,
said softener being selected from the group consisting of distearyl dimethyl ammonium chloride, dihydrogenated tallow dimethyl ammonium chloride, di-tallow dimethyl ammonium chloride, distearyl dimethyl ammonium methyl sulfate, dihydrogenated tallow dimethyl ammonium methyl sulfate, methyl-1-tallow amido ethyl-2-tallow imidazolinium methyl sulfate and methyl-1-oleyl amido ethyl-2-oleyl imidazolinium methyl sulfate,
said fatty acid soap being a mixture of $C_{10}$ to $C_{30}$ fatty acid alkali metal salts containing at least 50 weight percent $C_{10}$ to $C_{18}$ fatty acid salt,
said nonionic surfactant being selected from the group consisting of the condensation products of $C_2$ or $C_3$ alkylene oxide with $C_6$ to $C_{12}$ alkyl phenols, the condensation products of $C_2$ or $C_3$ alkylene oxide with $C_8$ to $C_{22}$ aliphatic alcohols and block condensation products of ethylene oxide and propylene oxide,
the weight percent of the nonionic surfactant in the fatty acid soap and nonionic surfactant mixture being from about 2 to about 50%,
the weight ratio of soap to softener being from about 8:1 to 1:3, and
the percent concentration of non-soap anionic surfactant being at least about $1.5\times+5$ wherein x represents the percent concentration of softener.

31. A composition according to claim 30 wherein the builder salt is selected from the group consisting of phosphate salts, alkali metal silicates, sodium carbonate salts, sodium bicarbonate salts, sodium borate salts, metakaolin clays and zeolites.

32. A composition according to claims 1, 2, 5, 20, 21, 22, 30 or 31 wherein the particulate detergent base of non-soap organic surfactant and builder salt is formed by agglomerating or beading means from dry or slurried ingredients.

33. A composition according to claim 32 wherein the detergent base is formed by spray drying, mechanical blending, prilling or granular mixing.

* * * * *

UNITED STATES PATENT AND TRADEMARK OFFICE

CERTIFICATE OF CORRECTION

PATENT NO. : 4,329,237

DATED : May 11, 1982

INVENTOR(S) : Harold E. Wixon

It is certified that error appears in the above—identified patent and that said Letters Patent is hereby corrected as shown below:

The term of this patent subsequent to October 28, 1997 has been disclaimed.

Signed and Sealed this

*Thirteenth* Day of *July 1982*

[SEAL]

*Attest:*

GERALD J. MOSSINGHOFF

*Attesting Officer*

*Commissioner of Patents and Trademarks*